United States Patent [19]

Radford

[11] Patent Number: 5,075,666

[45] Date of Patent: Dec. 24, 1991

[54] VARISTOR COMPOSIITON FOR HIGH ENERGY ABSORPTION

[75] Inventor: Kenneth C. Radford, North Huntingdon, Pa.

[73] Assignee: Electric Power Research Institute, Palo Alto, Calif.

[21] Appl. No.: 452,266

[22] Filed: Dec. 15, 1989

[51] Int. Cl.[5] ..... H01C 7/10

[52] U.S. Cl. ..... 338/21; 252/517

[58] Field of Search ..... 338/20, 21; 252/517-521

[56] References Cited

U.S. PATENT DOCUMENTS

| | | | |
|---|---|---|---|
| 3,811,103 | 5/1974 | Matsuoka et al. | 338/20 |
| 3,872,582 | 3/1975 | Matsuoka et al. | 338/20 X |
| 4,169,071 | 9/1979 | Eda et al. | 338/21 X |

*Primary Examiner*—Marvin M. Lateef

*Attorney, Agent, or Firm*—James B. Hinson

[57] ABSTRACT

The invention provides a disc for use in varistors. The disc is primarily composed of ZnO and includes predetermined concentrations of $Bi_2O_3$ in a selected ratio with $Sb_2O_3$.

8 Claims, 1 Drawing Sheet

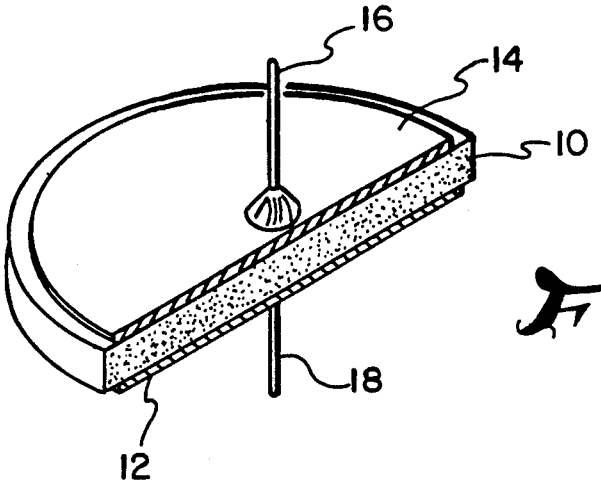
Fig. 1
Fig. 2
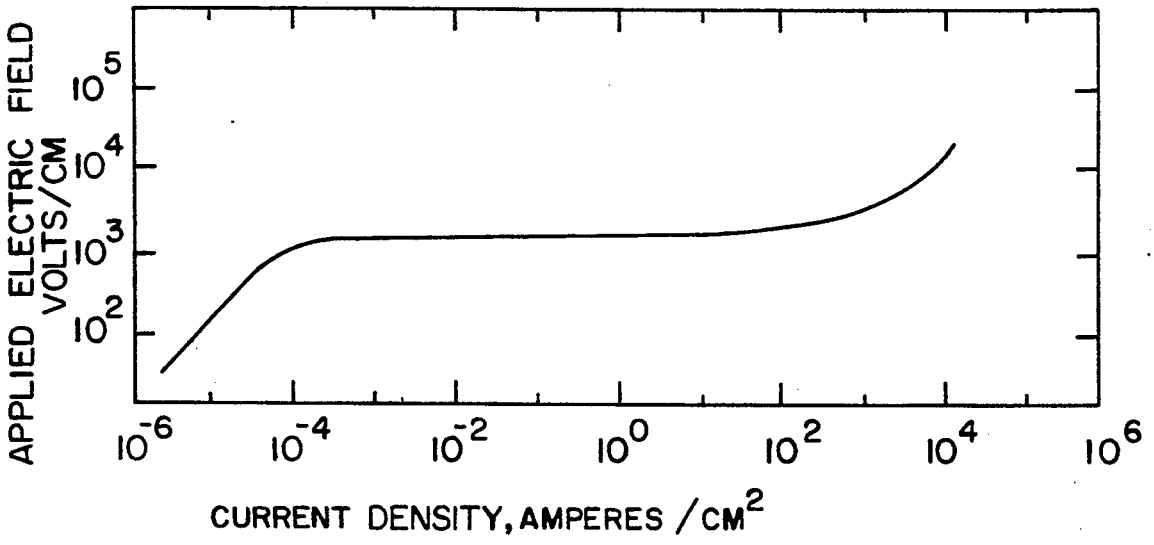

VARISTOR COMPOSIITON FOR HIGH ENERGY ABSORPTION

BACKGROUND OF THE INVENTION

1. Field of the Invention

The invention relates to varistors and more specifically to varistors having high energy absorption.

2. Summary Of The Prior Art

Voltage dependent resistors are well known in the prior art. In a typical application, the devices are continuously energized with the current increasing dramatically with increased voltage stress to limit the amplitude of the voltage surges.

A prior art patent search was made prior to filing this patent application. During the search the following patents were disclosed as being of interest.

U.S. Pat. No. 4,724,416, discloses varistors including various amounts of $Bi_2O_3$, $Sb_2O_3$ and $SiO_2$. U.S. Pat. No. 4,551,268, discloses varistors having boron oxide and silicon oxide.

U.S. Pat. No. 3,905,006, discloses a voltage dependent resistor which includes more than 50 mole percent of $SiO_2$.

U.S. Pat. No. 3,863,193, discloses a varistor including zinc oxide, bismuth oxide, cobalt oxide, boron trioxide, and at least one member selected from a group consisting of magnesium oxide, calcium oxide, barium oxide, and strontium oxide.

U.S. Pat. No. 3,811,103, discloses voltage dependent resistors, particularly useful in lightning arrestors which include zinc oxide, bismuth oxide, antimony oxide and nickel fluoride.

U.S. Pat. No. 3,760,318, discloses a method for forming voltage dependent resistors.

U.S. Pat. No. 3,760,318, discloses a varistor having ions including sodium diffused in the outer surface.

The above discussed patents are believed to be representative of the prior art.

SUMMARY OF THE INVENTION

Varistors are predominantly ZnO mixed with additives. In manufacturing a varistor the materials are ground and combined to form a powder which for purposes of this patent application is referred to as the "mixture". Portions of the mixture are pressed into the desired shape and sintered to form a disc for use in arrestors. The characteristics of the varistor are predominantly determined by the characteristics of the disc.

As demonstrated by the prior art discussed above, a wide variety of mixtures have been used to manufacture varistor discs. The characteristics of the varistor disc are predominantly determined by the composition of the mixture and the sintering process. The above discussed prior art also indicates that there is no satisfactory theory useful in predicting the performance of a particular mixture or sintering process. This being the case, it is required that the performance of each new mixture and each new sintering process to be used in manufacturing a varistor be experimentally verified.

The disclosed invention provides an improved varistor. The mixture used to form the varistor includes $Sb_2O_3$ and $Bi_2O_3$ in a critical ratio with other materials to produce a varistor disc which has an energy absorption greater than 1000 J/cc coupled with improved stability at a high operating temperature.

DESCRIPTION OF THE DRAWINGS

FIG. 1 is a drawing illustrating a typical varistor.

FIG. 2 is a chart illustrating the voltage current characteristic of a typical varistor.

DETAILED DESCRIPTION

The ability of varistors to protect electrical equipment against voltage surges by absorbing energy is dependent on the absorption capability of the varistor. The absorption capability is in turn determined by the constituents (mixture) used in manufacturing the varistor disc as well as the sintering process.

Typical commercial varistors have the ability of absorbing an energy pulse of about 100–200 J/cc. Operation of these varistors could be considerably improved by increasing the absorption capability to a figure in the range of 1000 J/cc. Such an absorption capability has not been realized utilizing prior art mixtures and manufacturing processes.

Energy absorption in a varistor is achieved by the conversion of electrical energy to thermal energy. Varistors operate on line continuously while a small resistive current flows through the varistor.

A typical varistor is illustrated in FIG. 1 and its voltage/current characteristic is illustrated in FIG. 2. The varistor includes a varistor disc 10 with electrodes, 12 and 14, affixed to opposed sides thereof. First and second leads, 16 and 18, are respectively connected to electrodes 12 and 14.

Varistors are composed mainly of ZnO in combination with other additives including $Bi_2O_3$, $Sb_2O_3$, $Co_3O_4$, $MnO_2$, $SiO_2$ and small levels of B, K or Na, and $Al_2O_3$. The appropriate concentrations of these materials prepared for use in manufacturing varistors is referred to as the mixture. A suitable quantity of the mixture is compacted into the desired shape and sintered to form the varistor disc.

Energy absorption of a varistor can be increased by increasing the sintering temperature or increasing the sintering time. However, increased sintering time can be uneconomical since it lowers the production rate. Increased sintering time results in some of the components of the mixture, including $Sb_2O_3$, B, K, and $Bi_2O_3$, vaporizing due to their volatility. These characteristics of typical commercial mixtures and processes for forming varistors have universally resulted in absorption rates less than 1000 J/cc.

In evaluating the disclosed invention typical varistors such as the varisitor illustrated in FIG. 1 were constructed and tested using various mixtures and sintering cycles. More specifically, the mixtures used in manufacturing the test varistors were prepared using standard commercial practices of milling the materials, spray drying the powder, cold pressing the powder into discs and sintering the discs under standard conditions of 1300° C. for two hours. After sintering the discs were lapped and tempered at 600° C. for two hours after which electrodes were applied and the varistor tested using standard testing techniques.

The limitations of prior art varistors are believed to be related to two fundamental processes. First, a mixture containing a high level of $Bi_2O_3$ is sufficiently volatile to create porosity conditions in the disc during the sintering process. These porosity conditions lead to disc puncture during high energy absorption conditions. Second, a mixture containing low level of $Bi_2O_3$ does not contain sufficient varistor forming material to produce a disc capable of high energy absorption even though it is more refractory and does not suffer severely from defects due to volatility of some of the materials.

To determine the effect of $Bi_2O_3$ level on the properties of the varistor, five mixtures were prepared respectively using 3, 1.7, 1.25, 0.875 and 0.5 m/o (mole percent) of $Bi_2O_3$. The test results for these varistors are tabulated below wherein $E_{0.5}$ represents the voltage at 0.5 ma/cm$^2$, the leakage current at room temperature of the varistor as RTiR, the energy absorption at $1.1E_{0.5}$ measured at 60Hz, and the alpha value measured between 0.5 ma/cm$^2$ and 250 A/cm$^2$.

| COMP | $Bi_2O_3$ m/o | $E_{0.5}$ V/cm | R.T. i.R μa/cm | ENERGY j/CM$^3$ | ALPHA |
|---|---|---|---|---|---|
| 902 | 3.0 | 1158 | 6.1 | 270 | 23 |
| 904 | 1.7 | 1309 | 7.3 | 807 | 25 |
| 929 | 1.25 | 1255 | 9.5 | 864 | 25 |
| 961 | 0.875 | 1499 | 6.0 | 558 | 25 |
| 932 | 0.5 | 1586 | 9.1 | 325 | 22 |

(m/o = mole percent)

From this tabulation it can be seen that the energy absorption peaked at an intermediate level of $Bi_2O_3$ as does the non-linearity exponent and resistive losses. From this it would appear that an intermediate $Bi_2O_3$ level is most beneficial to the attainment of high energy absorption.

The beneficial effect of increasing grain size by extended sintering time was examined by sintering two mixtures at 1250° C. and 1300° C. for times periods ranging from 2 to 20 hours. The results of this experiment are tabulated below.

| COMP | $Bi_2O_3$ M/O | Temp °C. | Time Hrs. | $E_{0.5}$ V/cm | R.T μa/cm | Energy J/cc | Alpha |
|---|---|---|---|---|---|---|---|
| 819 | 1.7 | 1250 | 5 | 1098 | 3.5 | 457 | 24 |
| | | | 10 | 962 | 3.6 | 696 | 24 |
| | | | 20 | 852 | 4.4 | 685 | 22 |
| | | | 20 | 852 | 4.4 | 685 | 22 |
| 957 | 1.25 | 1300 | 2 | 1423 | 3.9 | 655 | 27 |
| | | | 5 | 1228 | 3.9 | 736 | 25 |
| | | | 10 | 1124 | 3.6 | 793 | 26 |

From these tests it is clear that an increase in energy absorption can be attained by extending the sintering time. However, an extrapolation of these test results indicate that a sintering time in excess of 100 hours would be required in order to attain an absorption of 1000 J/cc. Also at the lower sintering temperature of 1250° C., the absorption peaked in the range of 10 to 20 hours. This clearly indicates that it is not practical to achieve the desired energy absorption rate commercially using these materials and sintering cycles.

Another material found to be useful in increasing the energy absorption of varistors is $Sb_2O_3$. This material is less volatile than $Bi_2O_3$, allowing for higher sintering temperatures. It has also been found that $Sb_2O_3$ is a grain growth inhibitor, allowing the turn-on voltage to be raised within a wide range of values. For example, with 1 M/O of $Sb_2O_3$ the turn-on voltage is 1158 V/cm with the energy absorption 270 J/cc. Increasing the $Sb_2O_3$ level to 2 M/O increases the turn-on voltage to 1354 V/cm and the energy absorption to 497 J/cc. This clearly demonstrates the beneficial result of this material in varistors mixtures.

It has also been found that the $Sb_2O_3/Bi_2O_3$ ratio is critical to achieving optimum varistor parameters. Ratios ranging from 0.3 to 2.0 were tested with an energy absorption of 899 J/cc and a turn-on voltage of 1452 V/cm being achieved. Experiments also verified that $SiO_2$ levels in the range of 1.0 m/o were particularly beneficial.

More specifically, the mixtures containing the above $Sb_2O_3/Bi_2O_3$ ratios were prepared and used to manufacture test varistors. Ratios of 1.14 and 1.18 were also compared in combination with $SiO_2$. The test results for these varistors are tabulated below.

| COMP | $Sb_2O_3/Bi_2O_3$ | $SiO_2$ | $E_{0.5}$ | R.T iR | Energy | Alpha |
|---|---|---|---|---|---|---|
| 902 | 0.3 | 0.5 | 1158 | 6.1 | 270 | 23 |
| 819 | 0.6 | 0.5 | 1239 | 6.7 | 547 | 23 |
| 957 | 1.2 | 0.5 | 1423 | 3.9 | 655 | 27 |
| 966 | 1.5 | 0.5 | 1452 | 6.0 | 558 | 25 |
| 961 | 1.7 | 0.5 | 1499 | 3.7 | 457 | 23 |
| 908 | 1.14 | 0.5 | 1354 | 1.9 | 497 | 25 |
| 914 | 1.18 | 1.0 | 1544 | 1.4 | 713 | 27 |

The above test results demonstrate that an intermediate $Bi_2O_3$ concentration, a critical $Sb_2O_3/Bi_2O_3$ ratio in the region of 1.4 and a predetermined concentration of $SiO_2$ to be the most desirable mixture. Because of the refractory characteristics of varistor discs manufactured using this mixture, the sintering time can be increased to further improve the characteristics of the varistor. The test results of an increased sintering time are tabulated below.

| COMP | Time Hrs. | $Bi_2O_3$ M/O | $Sb_2O_3/Bi_2O_3$ | $SiO_2$ M/O | $E_{0.5}$ | R.T iR μa/cm$^2$ | Stab Mins | Energy J/cc | Alpha |
|---|---|---|---|---|---|---|---|---|---|
| 965 | 2 | 1.0 | 1.4 | 1.0 | 1366 | 4.9 | 350 | 910 | 23 |
| | 5 | 1.0 | 1.4 | 1.0 | 1206 | 4.8 | 350 | 1170 | 24 |

Because of the refractory nature of this specific mixture the sintering time may be extended to improve the energy absorption without significant detrimental changes in the other parameters. Specifically, the goal of an energy absorption greater than 1000 J/cc was realized.

I claim:

1. A varistor disc formed by sintering a mixture in accordance with a sintering cycle which includes a selected sintering time and a selected sintering temperature, said mixture including a selected concentration of ZnO in combination with additives, said additives including $Sb_2O_3$ in a selected concentration, $Bi_2O_3$ in a concentration selected to produce a $Sb_2O_3/Bi_2O_3$ ratio in the range of 1.2 to 1.5 on a mole basis, and $SiO_2$ in a concentration substantially about 1.0 mole percent.

2. A varistor disc in accordance with claim 1 wherein said selected sintering time is in the range of 2 to 10 hours.

3. A varistor disc in accordance with claim 2 wherein said selected sintering temperature is in the range of 1100° to 1400° C.

4. A varistor disc in accordance with claim 3 wherein said sintering temperature is substantially 1300° c.

5. A varistor disc formed by sintering a mixture in accordance with a selected sintering cycle which includes a selected sintering temperature and a selected sintering time, said mixture including a selected concentration of ZnO in combination with additives, said additives inlcuding $Sb_2O_3$, $Bi_2O_3$ in a concentration substantially about 1.0 mole percent selected to produce a $Sb_2O_3/Bi_2O_3$ ratio in the range of 1.2 to 1.5 on a mole basis, and $SiO_2$ in a concentration substantially about 1.0 mole percent.

6. A varistor disc in accordance with claim 5 wherein said selected sintering time is in the range of 2 to 10 hours.

7. A varistor disc in accordance with claim 6 wherein said sintering temperature is in the range of 1100° to 1400° C.

8. A varistor disc in accordance with claim 7 wherein said sintering temperature is substantially 1300° C.

* * * * *